US011153686B2

(12) United States Patent
Kotulla

(10) Patent No.: US 11,153,686 B2
(45) Date of Patent: Oct. 19, 2021

(54) METHOD FOR OUTPUTTING AN AUDIO SIGNAL INTO AN INTERIOR VIA AN OUTPUT DEVICE COMPRISING A LEFT AND A RIGHT OUTPUT CHANNEL

(71) Applicant: ASK Industries GmbH, Niederwinkling (DE)

(72) Inventor: Daniel Kotulla, Mitterfels (DE)

(73) Assignee: ASK Industries GmbH, Niederwinkling (DE)

( * ) Notice: Subject to any disclaimer, the term of this patent is extended or adjusted under 35 U.S.C. 154(b) by 0 days.

(21) Appl. No.: 16/493,476

(22) PCT Filed: Mar. 14, 2018

(86) PCT No.: PCT/EP2018/056404
§ 371 (c)(1),
(2) Date: Sep. 12, 2019

(87) PCT Pub. No.: WO2018/172159
PCT Pub. Date: Sep. 27, 2018

(65) Prior Publication Data

US 2020/0137496 A1 Apr. 30, 2020

(30) Foreign Application Priority Data

Mar. 21, 2017 (DE) ..... 102017106022.7

(51) Int. Cl.
*H04R 5/04* (2006.01)
*H04R 3/12* (2006.01)
(Continued)

(52) U.S. Cl.
CPC ..... *H04R 5/04* (2013.01); *H04R 3/12* (2013.01); *H04R 5/02* (2013.01); *H04S 1/002* (2013.01);
(Continued)

(58) Field of Classification Search
None
See application file for complete search history.

(56) References Cited

U.S. PATENT DOCUMENTS 4,748,669 A * 5/1988 Klayman ..... H04S 1/005 381/1
2004/0136554 A1* 7/2004 Kirkeby ..... H04S 1/005 381/309
(Continued)

FOREIGN PATENT DOCUMENTS

CN 1956607 A 5/2007
CN 101826356 A 9/2010
(Continued)

*Primary Examiner* — James K Mooney
(74) *Attorney, Agent, or Firm* — Rimôn, P.C.

(57) ABSTRACT

Method for outputting an audio signal (S) into an interior (4) forming part of a passenger compartment (2) of a motor vehicle (3) via an acoustic output device (7) comprising a left and a right acoustic output channel (5, 6), comprising the steps:

supplying an audio signal (S), splitting of the supplied audio signal (S) into a plurality of acoustic audio signal components (S.1-S.3) dependent on the direction of perception, mixing of each acoustic audio signal component (S.1-S.3) dependent on the direction of perception to a right and/or a left output channel (5, 6) of an acoustic output device (7) comprising a right and a left acoustic output channel (5, 6), output of the acoustic audio signal components (S.1-S.3) dependent on the direction of perception via the right and/or the left acoustic output channel (5, 6) of the acoustic output device (7).

10 Claims, 1 Drawing Sheet

(51) Int. Cl.
*H04R 5/02* (2006.01)
*H04S 1/00* (2006.01)

(52) U.S. Cl.
CPC ..... *H04S 1/007* (2013.01); *H04R 2499/13* (2013.01); *H04S 2400/05* (2013.01)

(56) References Cited

U.S. PATENT DOCUMENTS

| | | | | |
|---|---|---|---|---|
| 2007/0104331 | A1 | 5/2007 | Sawashi et al. | |
| 2008/0298597 | A1 | 12/2008 | Turku et al. | |
| 2010/0226498 | A1 | 9/2010 | Kino et al. | |
| 2015/0189438 | A1 | 7/2015 | Hampiholi et al. | |
| 2018/0249268 | A1 * | 8/2018 | Wu ..... | G10K 11/175 |

FOREIGN PATENT DOCUMENTS

| | | | |
|---|---|---|---|
| DE | 102012025016 | B3 | 5/2014 |
| WO | 8706090 | A1 | 10/1987 |
| WO | 03094369 | A2 | 11/2003 |
| WO | 2006056661 | A1 | 6/2006 |
| WO | WO2017074321 | A1 * | 5/2017 |

* cited by examiner

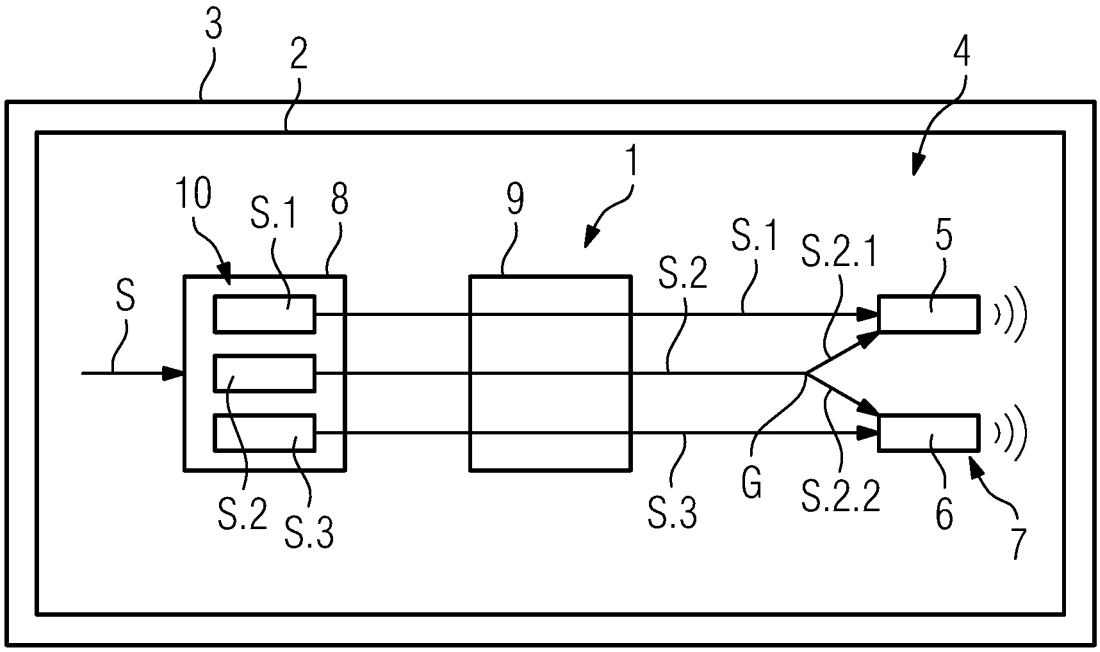
3
2
4
1
10
S.1
8
9
S.1
S.2.1
5
S
S.2
S.2
S.3
S.3
G
S.2.2
6
7

METHOD FOR OUTPUTTING AN AUDIO SIGNAL INTO AN INTERIOR VIA AN OUTPUT DEVICE COMPRISING A LEFT AND A RIGHT OUTPUT CHANNEL

The invention relates to a method for outputting an audio signal into an interior forming part of a passenger compartment of a motor vehicle via an acoustic output device comprising a left and a right acoustic output channel.

It is known that modern motor vehicles are equipped with acoustic output devices, which comprise a plurality of acoustic output channels arranged distributed in the passenger compartment.

In the front area of the passenger compartment at least one output channel is typically present on the driver's side, i.e. typically a left output channel, one output channel, i.e. typically a right output channel, is present on the passenger side and a center output channel is present arranged centrally between the output channel on the driver's side and on the passenger side. The center output channel is used to guarantee the best possible stereo width even outside the longitudinal center line of the vehicle. If no center output channel exists, the center portion of an audio signal perceived on the part of the listener "migrates" to the nearest output channel on the driver's or passenger's side.

A requirement exists for a practical technical solution to be able to output an audio signal via an output device comprising only two output channels, i.e. a right and a left output channel, with a comparable stereo width. The requirement arises in particular with regard to the development of low-cost output devices for motor vehicles, which comprise only two output channels, i.e. an output channel on the driver's side and one on the passenger's side and no center output channel.

The object of the invention is thus to specify a method for outputting an audio signal into an interior forming part of a passenger compartment of a motor vehicle via an acoustic output device comprising a left and a right acoustic output channel, which facilitates output of an audio signal with the best possible stereo width without the use of a center output channel.

The object is achieved by a method according to claim 1. The dependent claims to this relate to possible embodiments of the method.

The method described herein is used to output an audio signal into an interior forming part of a passenger compartment of a motor vehicle via an acoustic output device ("output device") comprising a left and a right acoustic output channel—a respective output channel is typically formed by a loudspeaker. The output device is typically installed in the motor vehicle. The two output channels of the output device are typically arranged in a passenger compartment of a motor vehicle, so that the signals that can be output via this can be output into the passenger compartment. The aim of the method is to be able to output an audio signal via an output device comprising only two output channels, i.e. a right and a left output channel and no center output channel, with the best possible stereo width. A virtual center output channel can be created in such a way.

In a first method step, an acoustic audio signal ("audio signal") is supplied. The audio signal is typically a stereo signal. The audio signal can be supplied in various ways. For example, the audio signal can be supplied via an audio carrier, i.e. a CD, for example, a data carrier, i.e. a hard drive memory, for example, or a data network, i.e. the Internet, for example. The audio signal can be e.g. a piece of music, a piece of text, etc.

In a second method step, the audio signal supplied is split into several, i.e. as set out below, in particular three, audio signal components ("audio signal component") that are dependent on the direction of perception. To this end the audio signal is examined by way of suitable examination devices or algorithms with regard to individual audio signal components, which correspond or would correspond in an actual output of the audio signal via an output device comprising only two output channels, i.e. a left and a right output channel, to an output direction or position perceived by a listener positioned in a defined position relative to the output device outputting the respective audio signal. A suitably defined position of a listener relative to an output device outputting the audio signal can be e.g. the apex of the stereo triangle, at which the listener forms an equilateral triangle with the output channels.

A corresponding audio signal component can be a center audio signal component, which would correspond to an output direction or position perceived centrally by a listener in the actual output of the audio signal via an output device comprising two output channels, a left audio signal component, which would correspond to an output direction or position perceived to be (more) left (compared with a center audio signal component) by a listener in an actual output of the audio signal via an output device comprising two output channels, and a right audio signal component, which would correspond to an output direction or position perceived to be (more) right (compared with a center audio signal component) by a listener in an actual output of the audio signal via an output device comprising two output channels.

The splitting of the audio signal performed by means of suitable splitting devices or algorithms typically supplies (precisely) three audio signal components according to the method; the audio signal is therefore split according to the method typically into (precisely) three audio signal components, namely a left audio signal component, which contains all or only portions of the audio signal that are perceived left of the center of the output or are located left of the center of the output, a right audio signal component, which contains all or only portions of the audio signal that are perceived right of the center of the output or are located right of the center of the output, and a center audio signal component, which contains all or only portions of the audio signal that are perceived in the center of the output or are located in the center of the output.

In a third method step, audio signal components on the right and/or the left output channel of an output device comprising a right and a left output channel are mixed. Each audio signal component obtained from the splitting of the audio signal is accordingly mixed to a certain output channel of an output device comprising two output channels. In other words, each audio signal component is associated with one of the two output channels of the output device, via which the respective audio signal component is subsequently output. For the center audio signal component it is the case that this can be mixed, split proportionately, also to both output channels.

In a fourth step of the method, the output of the audio signal components finally takes place via the two output channels of the output device. Due to this, the best possible stereo width is made possible for a listener positioned on the driver's or passenger's side—the output takes place in an interior forming part of a passenger compartment of a motor vehicle—without the necessity of a (dedicated) center output channel.

In one embodiment of the method, the splitting of the audio signal supplied into respective audio signal components can be carried out by means of a source separation device. A suitable source separation device can be implemented e.g. by a source separation algorithm. A suitable method for source separation and a suitable source separation algorithm are described e.g. in the German patent DE 10 2012 025 016 B3, to the disclosure content of which reference is made explicitly.

As mentioned, the audio signal supplied is typically split into a left audio signal component, a right audio signal component and a center audio signal component. The left audio signal component is typically output via the left output channel of the output device, the right audio signal component is typically output via the right output channel of the output device and the center audio signal component is typically output via the left and/or via the right output channel of the output device. The center audio signal component can accordingly be output both via the right and via the left output channel of the output device.

As also mentioned, the center audio signal component can be output split proportionately via both output channels. In particular, it is possible that a first portion of the center audio signal component determined by a weighting factor is output via the right output channel of the output device and a second portion of the center audio signal component determined by a weighting factor is output via the left output channel of the output device. A first portion of the center audio signal component can accordingly be output mixed with the right audio signal component via the right output channel and a second portion of the center audio signal component can be mixed with the left audio signal component and output via the left output channel of the output device. The weighting of the portions of the center audio signal component can take place equally or unequally; a first portion of the center audio signal component can thus be greater than a second portion of the center audio signal component or vice versa.

A static or dynamic (variable) weighting factor can be used according to the invention. In the latter case, the weighting factor can be varied e.g. as a function of definable or defined boundary conditions. For example, the weighting factor can be varied as a function of certain boundary conditions relating to the occupation of the passenger compartment by vehicle occupants. A weighting of the center audio signal component can thus take place as a function of the distribution of vehicle occupants located inside the passenger compartment. If the majority of the vehicle occupants are located on the driver's side, the center audio signal component can be output e.g. with a higher weighting via the respective driver's side output channel, if the majority of the vehicle occupants are located on the passenger side, the center audio signal component can be output e.g. with a higher weighting via the respective passenger's side output channel.

As well as the method, the invention relates to a device for outputting an audio signal into an interior forming part of a passenger compartment of a motor vehicle via an acoustic output device comprising a left and a right acoustic output channel. The device is characterized by a splitting device implemented in a hardware and/or software manner, which is adapted to split a supplied audio signal into a plurality of audio signal components, a mixing device implemented in a hardware and/or software manner, which is adapted to mix each audio signal component to a right or left output channel of an output device comprising a right and a left output channel, and an output device comprising two output channels, which is adapted to output the audio signal components via the right and/or left output channel. The device is adapted to carry out the method. All explanations in connection with the method described herein therefore apply by analogy to the device.

As well as the method and the device, the invention also relates to a motor vehicle, which comprises a corresponding device. All explanations in connection with the method described herein therefore apply by analogy to the motor vehicle.

The invention is explained in greater detail by means of an exemplary embodiment in the drawing figures. Here the sole FIGURE shows a schematic diagram of a device according to an exemplary embodiment.

The sole FIGURE shows a schematic diagram of a device 1 according to an exemplary embodiment. The device 1 is adapted to output an audio signal into an interior 4 forming part of a passenger compartment 2 of a motor vehicle 3 via an acoustic output device 7 comprising a left and a right acoustic output channel 5, 6.

The device 1 comprises as functional components a splitting device 8 implemented in a hardware and/or software manner, a mixing device 9 implemented in a hardware and/or software manner and the output device 7 comprising a left and a right output channel 5, 6 (loudspeaker). The splitting device 8 is adapted to split a supplied audio signal S, i.e. a piece of music, for example, into several audio signal components S.1-S.3. The mixing device 9 is adapted to mix an audio signal component S.1-S.3 to an output channel 5, 6 of the output device 7. The functional interaction of said functional components of the device 1 is described in greater detail in connection with the following explanation of the method that can be implemented using the device 1 for outputting an audio signal into the interior 4 of the motor vehicle 3 forming part of the passenger compartment 2.

The device 1 is thus adapted to carry out a method for outputting an audio signal S into an interior 4 forming part of a passenger compartment 2 of a motor vehicle 3 via an output device 7 comprising a left and a right output channel 5, 6. The aim of the method is to be able to output an audio signal S via an output device 7 comprising only two output channels 5, 6, i.e. a right and a left output channel and no center output channel, with the best possible stereo width.

In a first method step, an audio signal S is supplied. The audio signal S is typically a stereo signal. The audio signal S can be supplied in different ways. For example, the audio signal S can be supplied via a sound carrier, i.e. a CD, for example, a data carrier, i.e. a hard drive memory, for example, or a data network, i.e. the Internet, for example. The audio signal S can be e.g. a recording of a piece of music, a piece of text, etc.

In a second method step, the audio signal S supplied is split by means of the splitting device 8 into three audio signal components S.1-S.3 dependent on the direction of perception. To do this, the audio signal S is examined via suitable examination algorithms that can be or are associated by means of the splitting device 8 with regard to individual audio signal components S.1-S.3, which in the actual output of the audio signal S via an output device comprising two output channels, i.e. a left and a right output channel, correspond or would correspond to an output direction or position perceived by a listener. The actual splitting of the audio signal S into the audio signal components S.1-S.3 takes place via a source separation device 10 belonging to the splitting device 8 and comprising one or more source separation algorithms.

According to the method, the audio signal S is split into a left audio signal component S.1, a center audio signal component S.2, and a right audio signal component S.3.

The center audio signal component S.2 corresponds to an output direction or position perceived centrally by a listener on actual output of the audio signal S via an output device comprising two output channels. The left audio signal component S.1 corresponds to an output direction or position perceived to be (more) left (compared with a center audio signal component) by a listener on actual output of the audio signal S via an output device comprising two output channels. The right audio signal component S.3 corresponds to an output direction or position perceived to be (more) right (compared with a center audio signal component) by a listener on actual output of the audio signal S via an output device comprising two output channels.

The splitting of the audio signal S accordingly delivers (precisely) three audio signal components according to the method, namely a left audio signal component S.1, which contains all or just portions of the audio signal S, which are perceived to the left of center of the output or which are located to the left of center of the output, a right audio signal component S.3, which contains all or just portions of the audio signal S, which are perceived to the right of center of the output or which are located to the right of center of the output, and a center audio signal component S.2, contains all or just portions of the audio signal S, which are perceived in the center of the output or which are located in the center of the output.

In a third method step, the audio signal components S.1-S.3 are mixed by means of the mixing device 9 to the right and/or the left output channel 5, 6 of the output device 7. Each audio signal component S.1-S.3 is accordingly mixed to a certain output channel 5, 6 of the output device. For the center audio signal component S.2 it is the case that this can be mixed split proportionately also to both output channels 5, 6.

In a fourth method step, the output of the audio signal components S.1-S.3 takes place via the two output channels 5, 6 of the output device 7. The left audio signal component S.1 is output via the left output channel 5 of the output device 7, the right audio signal component S.3 is output via the right output channel 6 of the output device 7 and the center audio signal component S.2 is output via the left and/or via the right output channel 5, 6 of the output device 7. The best possible stereo width is facilitated by this for a listener positioned on the driver's side or passenger's side without the necessity of a dedicated center output channel.

As mentioned, the center audio signal component can be mixed split proportionately to both output channels 5, 6 and accordingly output split proportionately via both output channels 5, 6. In this case a first portion S.2.1 of the center audio signal component S.2 determined by a weighting factor G can be output via the left output channel 5 of the output device 7 and a second portion S.2.2 of the center audio signal component S.2 determined by a weighting factor G can be output via the right output channel 6 of the output device 7. The first portion S.2.1 of the center audio signal component S.2 can accordingly be output mixed with the left audio signal component S.1 via the left output channel 5 and the second portion S.2.2 of the center audio signal portion S.2 can be mixed with the right audio signal portion S.3 and output via the right output channel 6 of the output device 7. The weighting of the portions S.2.1, S.2.2 of the center audio signal component S.2 can take place equally or unequally; a first portion S.2.1 of the center audio signal component S.2 can thus be greater than a second portion S.2.2 of the center audio signal component S.2, or vice versa.

A static or dynamic (variable) weighting factor G can be used according to the method. In the latter case, the weighting factor G can be varied e.g. as a function of definable or defined boundary conditions. For example, the weighting factor G can be varied as a function of certain boundary conditions relating to the occupation of the passenger compartment 2 by vehicle occupants. A weighting of the center audio signal component S.2 can accordingly take place as a function of the distribution of respective vehicle occupants located inside the passenger compartment 2. If the majority of vehicle occupants are located on the driver's side, the center audio signal component S.2 can be output e.g. with a higher weighting via the respective driver's side output channel 5, 6, if the majority of vehicle occupants are located on the passenger's side, the center audio signal component S.2 can be output e.g. with a higher weighting via the respective passenger's side output channel 5, 6.

The invention claimed is:

1. Method for outputting an audio signal into an interior forming part of a passenger compartment of a motor vehicle via an acoustic output device comprising a left and a right acoustic output channel, comprising the steps:

supplying an audio signal to be split into a plurality of acoustic audio signal components, each corresponding to a listener's aural direction of perception, splitting, via a splitting device comprising a source separation device, of the supplied audio signal into a plurality of acoustic audio signal components each corresponding to a listener's aural direction of perception, mixing, via the mixing device, of each of the plurality of acoustic audio signal components dependent on the listener's aural direction of perception to a right or left output channel of an acoustic output device comprising a right and a left acoustic output channel into a plurality of mixed acoustic audio signal components comprising a center audio signal component whereby a virtual center output channel for the center audio signal is generated, and outputting each of the plurality of mixed acoustic audio signal components, via the right and the left acoustic output channel of the acoustic output device, whereby the center audio signal component is output via the right and/or the left acoustic output channel of the acoustic output device; wherein the splitting device and the mixing device are separate devices, and before splitting, the audio signal is analyzed via analyzing algorithms associated with the splitting device to determine individual audio signal components, which in an output of the audio signal via an output device comprising a left and a right output channel would correspond to an output direction or position perceived by a listener in a defined listening position relative to such an output device comprising a left and a right output channel.

2. Method according to claim 1, wherein the supplied audio signal is split into a center audio signal component, a left audio signal component perceived to the left of the center audio signal component and a right audio signal component perceived to the right of the center audio signal component.

3. Method according to claim 2, wherein the left audio signal component is output via the left acoustic output channel of the acoustic output device, the right audio signal component is output via the right acoustic output channel of the acoustic output device, and the center audio signal component is output via the left and/or via the right output channel of the output device.

4. Method according to claim 3, wherein the center audio signal component is output both via the right and via the left acoustic output channel of the acoustic output device.

5. Method according to claim 4, wherein a first portion of the center audio signal component determined by a weighting factor is output via the left acoustic output channel of the acoustic output device and a second portion of the center audio signal component determined by a weighting factor is output via the right acoustic output channel of the acoustic output device.

6. Method according to claim 5, wherein the weighting factor is varied as a function of definable or defined boundary conditions.

7. Method according to claim 6, wherein the weighting factor is varied as a function of certain boundary conditions relating to the occupation of a passenger compartment by vehicle occupants.

8. Method according to claim 1, wherein the audio signal is a stereo signal.

9. Device for outputting an audio signal into an interior forming part of a passenger compartment of a motor vehicle via an acoustic output device comprising a left and a right acoustic output channel, comprising:

a splitting device, comprising a source separation device, which is adapted to split a supplied audio signal into a plurality of acoustic audio signal components each corresponding to a listener's aural direction of perception, a mixing device, which is adapted to mix each acoustic audio signal component each corresponding to a listener's aural direction of perception to a right or a left output channel of an acoustic output device comprising a right and a left acoustic output channel and to generate a virtual center output channel for one or more center audio signal components obtained through splitting of the supplied audio signal, and an acoustic output device comprising two acoustic output channels that is adapted to output the acoustic audio signal components each corresponding to a listener's aural direction of perception via the right and left acoustic output channel of the acoustic output device, wherein the splitting device is configured to analyze the supplied audio signal for individual signal components before splitting the audio signal, wherein the audio signal is analyzed via analyzing algorithms associated with the splitting device to determine individual audio signal components, which in an output of the audio signal via an output device comprising a left and a right output channel would correspond to an output direction or position perceived by a listener in a defined listening.

10. A motor vehicle, comprising the device of claim 9.

* * * * *